US005469996A

United States Patent [19]

Hürlimann

[11] Patent Number: 5,469,996

[45] Date of Patent: Nov. 28, 1995

[54] THREADING DEVICE

[75] Inventor: Paul Hürlimann, Baden, Switzerland

[73] Assignee: Tavaro, S.A., Geneva, Switzerland

[21] Appl. No.: 146,017

[22] PCT Filed: Mar. 8, 1993

[86] PCT No.: PCT/CH93/00058

§ 371 Date: Nov. 9, 1993

§ 102(e) Date: Nov. 9, 1993

[87] PCT Pub. No.: WO93/18220

PCT Pub. Date: Sep. 16, 1993

[30] Foreign Application Priority Data

Mar. 9, 1992 [CH] Switzerland ..... 00743/92

[51] Int. Cl.[6] ..... D05B 87/02

[52] U.S. Cl. ..... 223/99; 112/225

[58] Field of Search ..... 112/224, 225; 223/99

[56] References Cited

U.S. PATENT DOCUMENTS

| | | | |
|---|---|---|---|
| 882,204 | 3/1908 | Lassen | 223/99 |
| 912,915 | 2/1909 | Stockland | 223/99 |
| 2,483,595 | 10/1949 | Olson | 112/225 |
| 2,655,886 | 10/1953 | Ingwer | 112/225 |
| 2,667,294 | 1/1954 | Hoeckele | 223/99 |
| 2,777,622 | 1/1957 | Fehlmann | 223/99 |
| 4,557,408 | 12/1985 | Biemans | 223/99 |

FOREIGN PATENT DOCUMENTS

| | | | |
|---|---|---|---|
| 925147 | 8/1947 | France . | |
| 1104687 | 11/1955 | France . | |
| 70341 | 4/1959 | France . | |
| 1255942 | 11/1961 | France . | |
| 631952 | 6/1936 | Germany . | |
| 0270031 | 11/1950 | Switzerland | 223/99 |
| 313971 | 7/1956 | Switzerland . | |

*Primary Examiner*—Peter Nerbun

*Attorney, Agent, or Firm*—Cushman Darby & Cushman

[57] ABSTRACT

A device comprising a body with a sleeve slidably mounted thereon and attached to a blade which is slidably engaged ina longitudinal slot provided in the body and forming a sheath for said blade. A spring arranged within the sleeve between it and the body holds the blade in a retracted position inside the sheath. The projecting end of the body has four points for positioning the device relative to the needle to be threaded and the thread, and within range of a tip of the blade which may be "unsheathed" by manually moving the sleeve towards said points and said needle so that on the way it engages the thread between the points and leads it through the eye of the needle.

3 Claims, 8 Drawing Sheets

THREADING DEVICE

BACKGROUND OF THE INVENTION

The present invention relates to a threading device for threading a sewing thread through the eye of the needle, which may be a needle for a sewing or embroidering machine, that is to say fixed to one end of an axially sliding rod, or a needle for manual sewing.

DESCRIPTION OF THE PRIOR ART

Devices of this kind intended for one or other of these applications are numerous. The structural components of most of these devices for machine applications are generally fixed permanently on the machine concerned, for example on its casing, on the support or on the presser foot, or even on the needle rod. Usually they comprise a hook and pusher for engaging the thread that is to be threaded and having dimensions compatible with those of the eye of the needle through which it must pass under the action of a control mechanism having a relatively complicated and often delicate structure.

Other than the relatively high price of such devices, it should be noted that their operation is not always simple for the user and that their presence hardly contributes to improve the aesthetic appearance of the machines on which they are provided. Furthermore, due to their particular construction, it is not rare that certain components of these known threading devices are arranged such that, particularly at the time of threading proper, they constitute an inconvenience for the user whether it be purely visual or volumetric in nature, rendering difficult the observation of the threading process, even the access of the hands to the immediate environment around the eye of the needle.

Among the numerous documents concerning such threading devices of this type will be cited, by way of example, U.S. Pat. Nos. 2,767,671, 3,485,194, 4,300,463, and 5,143,005.

Devices have also been proposed for permitting the automatic introduction of a thread into the eye of a sewing or embroidering machine, which are not fixed permanently on these machines. It is a question, in this case, of accessory devices that the user brings manually to the needle of the machine, solely for the purpose of passing the sewing thread through the eye of the needle, and which the user removes at the end of this operation. Here also the solutions proposed are numerous. By way of example, reference is made to U.S. Pat. Nos. 4,461,409 and 4,557,408.

As for devices particularly intended for the threading of a needle for manual sewing, many are known: U.S. Pat. Nos. 2,281,480, 2,679,959, and U.S. Pat. No. 5,143,005 cited above, as well as Soviet Patent 84-187947/30 and British Patent 1,213,613 show several examples of the most structured devices.

SUMMARY OF THE INVENTION

The present invention provides a device for threading a sewing needle, comprising a body having an axial passage open at least at a first end thereof; a movable member carrying a blade having a thread gripper member adjacent a tip thereof, the movable member being displaceable in the passage between a first extreme position, in which the blade is withdrawn into the passage, and a second position in which the blade at least partly protrudes from the body; a pusher member integral with the movable member and slidably mounted on a second end of the body, opposite the first end thereof; at least one resilient member for biasing the movable member into the first extreme position disposed between the pusher member and the body; locating means on the first end of the body for longitudinally engaging the needle to be threaded and orienting the body relative thereto; notch means provided on the first end of the body for receiving a thread therein, the notch means being profiled at the bottom thereof so that a thread inserted therein is frictionally retained in position; and the blade being extendable through the notch means into an eye of the needle and coplanar with a transverse axis thereof, whereby as the gripping member passes through the notch it picks up the thread and carries it through the eye of the needle.

BRIEF DESCRIPTION OF THE DRAWINGS

The attached drawings show one embodiment of the invention by way of example.

FIG. 6 is a perspective view of the device according to the invention in the position occupied at the beginning of the process of threading a needle of a sewing machine.

FIGS. 7 and 8 show, in partial elevation and in section along lines VIII—VIII of FIG. 7 respectively, the position occupied by certain components of the device at the beginning of the threading operation.

FIG. 9 is a perspective view showing the device according to the invention in the fully extended position of a thread through the eye of a needle of a sewing machine.

FIGS. 10 and 11 show, on a larger scale, in partial elevation and in section along line XI—XI respectively, the device according to the invention in its position visible in FIG. 9.

FIG. 12 shows, in partial horizontal section, the device according to the invention at the end of the threading process.

DESCRIPTION OF THE PREFERRED EMBODIMENTS

Figure 1:
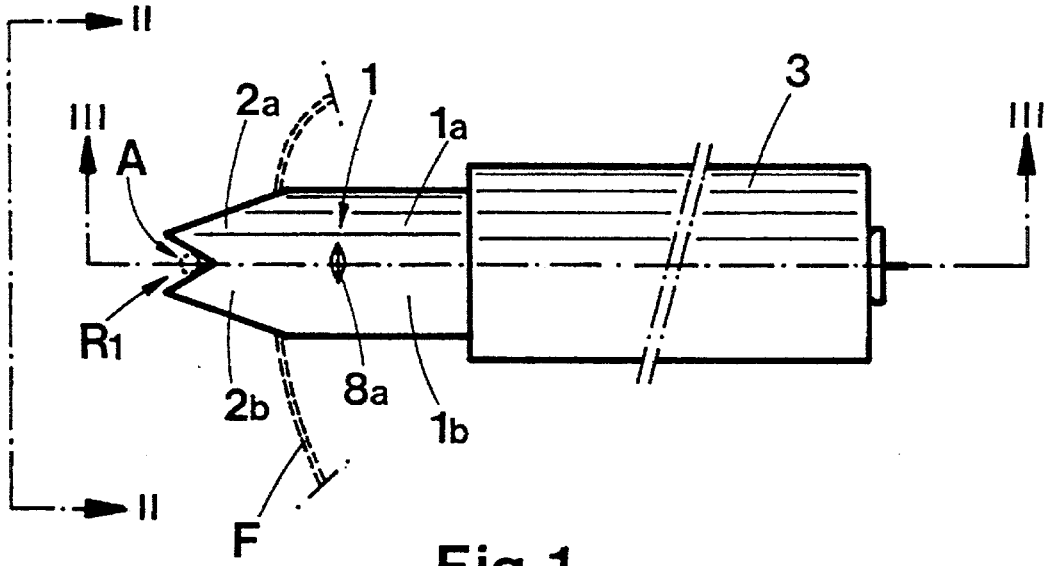
FIG. 1 is a plan view of the device.

The device shown in the drawing (FIG. 1) comprises a cylindrical body 1, whose left part has four fingers 2*a*, 2*b*, 2*c* and 2*d* and whose right part has a slidable sleeve 3 subject to the action of a return spring 4 (FIG. 3) disposed in its interior between the end face of the right part of the body 1 and a flange 3*a* of sleeve 3.

Figure 3:
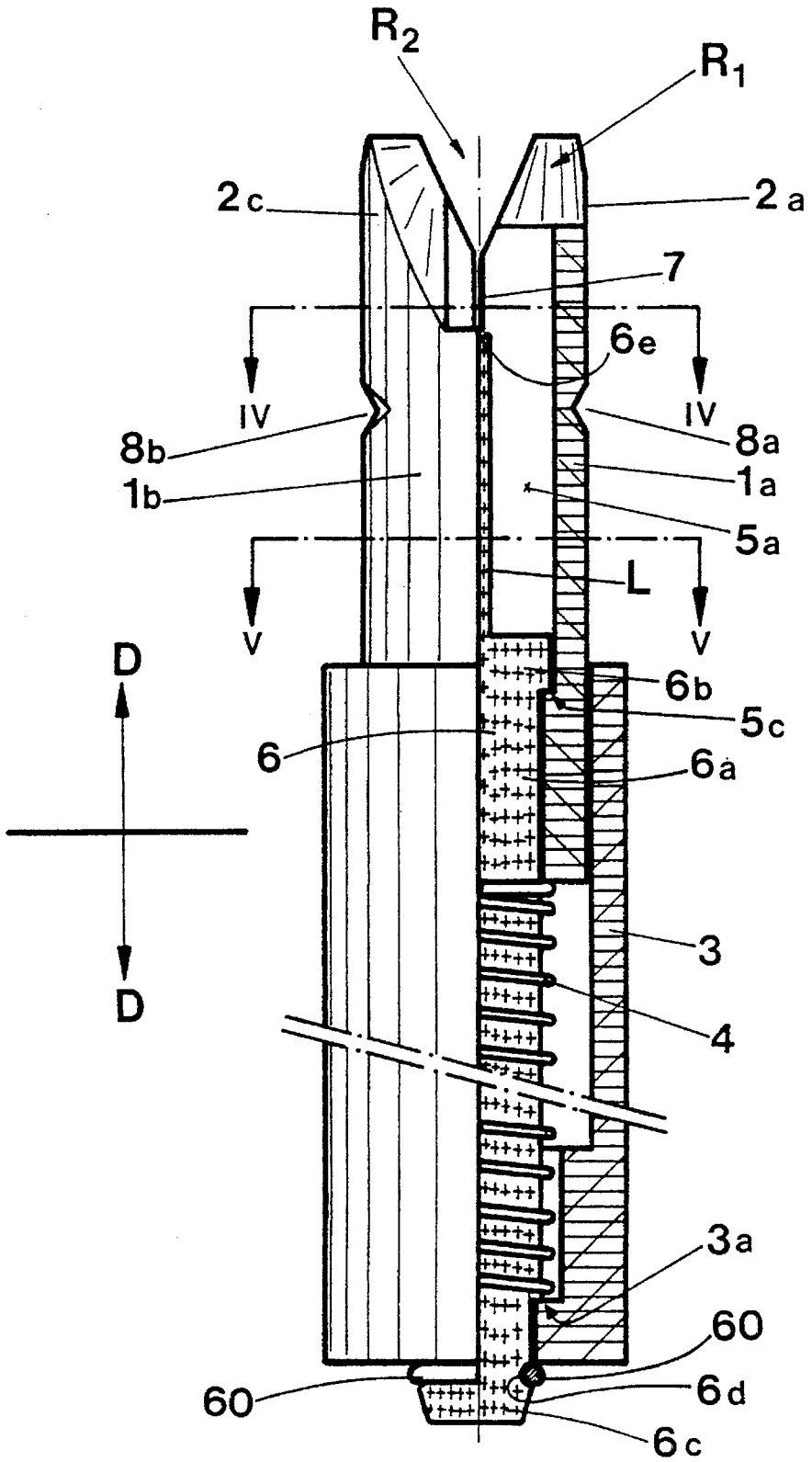
FIG. 3 is a lateral elevational view of the device of FIG. 1 in partial section along line III—III of this figure.
Figure 4:
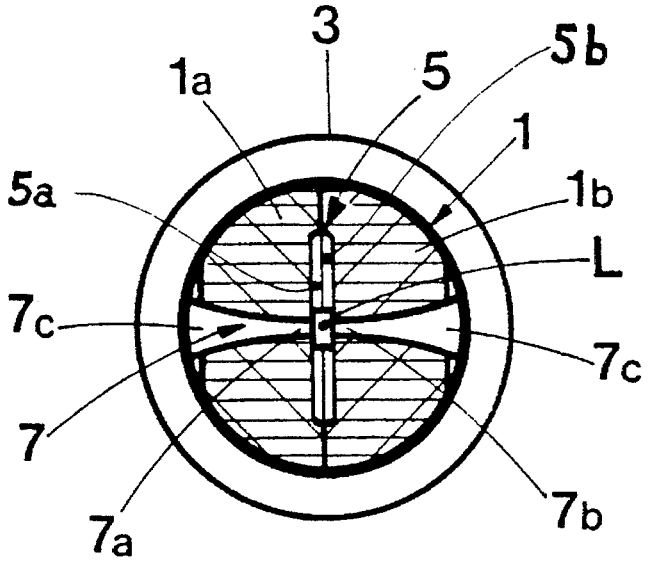
FIGS. 4 and 5 are sections taken along lines IV—IV and V—V respectively of FIG. 3.
Figure 5:
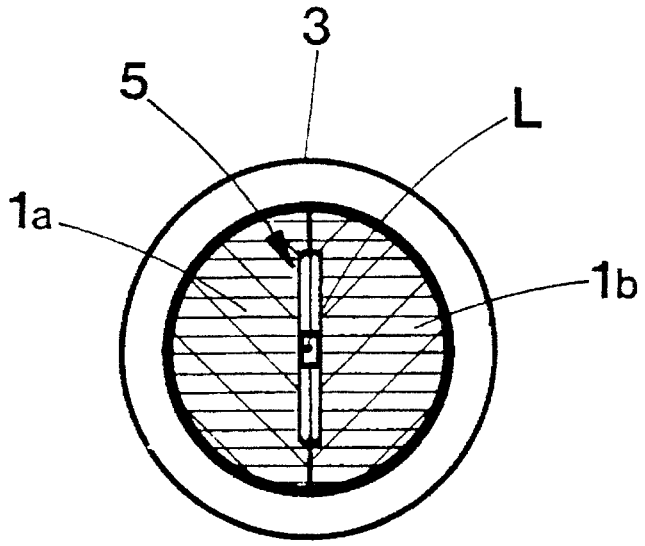

The body 1 comprises an assembly of two shells 1*a* and 1*b* (FIGS. 1, 3 to 5) made integral by any suitable means, for example by gluing or welding with ultrasound, whose opposing faces have respective rectangular section grooves 5*a*, 5*b* extending from the right end, in the drawing, of the body 1 to the vicinity of the previously mentioned fingers 2*a* to 2*d* (FIG. 3 and 5).

By way of example, for an overall length of the device shown of approximately 4 cm, the length of the body 1 can be in the order of 20 mm and its diameter in the order of 6 mm, the sleeve 3 having a length of 25 mm for an exterior diameter of 8 mm. As far as the grooves 5*a* and 5*b* are concerned, their dimensions can be, for example, 17 mm in length, in the order of 4 mm in width, and in the order of 2/10 of a mm in depth.

Upon assembly of the shells 1*a* and 1*b* of the body 1, the grooves 5*a* and 5*b* of the shells form a longitudinal slit 5, having a length of 4/10 of a mm for example, in the interior of which is slidably mounted a blade 6, for example having a thickness of 2 to 3/10 of a mm.

As shown in FIG. 3, the blade 6 has a uniform length over its median part 6*a*, slightly less than the height of the groove 5 with the lateral edges of which it is in sliding contact through its part 6*b*. This constitutes a kind of guide shoe for the blade 6 in direction D or D' (FIG. 3), such that the sleeve 3 is displaced in the direction D against the action of the spring 4 or under the action of the latter in the direction D'.

This shoe forms, in addition, an axial blocking member for the blade 6 limiting the displacement in this direction D' by abutment with the shoulder 5*c* (FIG. 3) of the body 1. Such a shoulder is, of course, formed by the junction of the shells 1*a* and 1*b* of the body, which each form half thereof.

At the opposite end of the part 6*b*, the blade 6 has, in addition, a part 6*c* having a length less than that of the part 6*a* and substantially corresponding to the diameter of the opening of the flange 3*a* of the sleeve 3 through which it freely passes. Due to this fact and for reasons that will become apparent later, the sleeve and the blade 6, and also the body assembly 1 with which it is associated, can be angularly displaced relative to each other by reciprocal pivoting of the part 6*c* of the blade and the annular wall bounding said opening of the flange 3*a*.

Over the projecting portion of this part 6*c*, the blade 6 has two notches 6*d* for positioning and maintaining a spring clip 60 limiting the movement of the sleeve 3 in the direction D', and, therefore, its complete expulsion from the body 1 in which it slides.

It should be pointed out, in addition, that under the action of the spring 4, the blade 6, through the lower end of its median part 6*a* (FIG. 3) abuts the flange 3*a* of the sleeve 3. Reciprocally, when the sleeve 3 is displaced in direction D, the latter entrains the blade 6 in the same direction, due to the force exerted by its flange 3*a* on the part 6*a* of the blade.

Beyond its part 6*b*, the blade 6 is in the form of a lancet L whose free end has a triangular notch 6*e* whose function will become apparent later. For a device of the above-mentioned dimensions, the lancet L may have, for example, a length in the order of 10 mm with a width in the order of 3 to 4/10 of a mm and a thickness in the order of 1/10 of a mm.

As shown in the drawing (FIG. 1 and 3), the four fingers 2*a* to 2*d* formed on the body 1 of the device according to the invention have a tapered shape, in this case a pseudo-pyramidal shape. They can, in a variant, be of pyramidal, truncated-pyramidal, pseudo-conical, conical, trunco-conical, triangular section polyhedral, etc., in shape.

Figure 7:
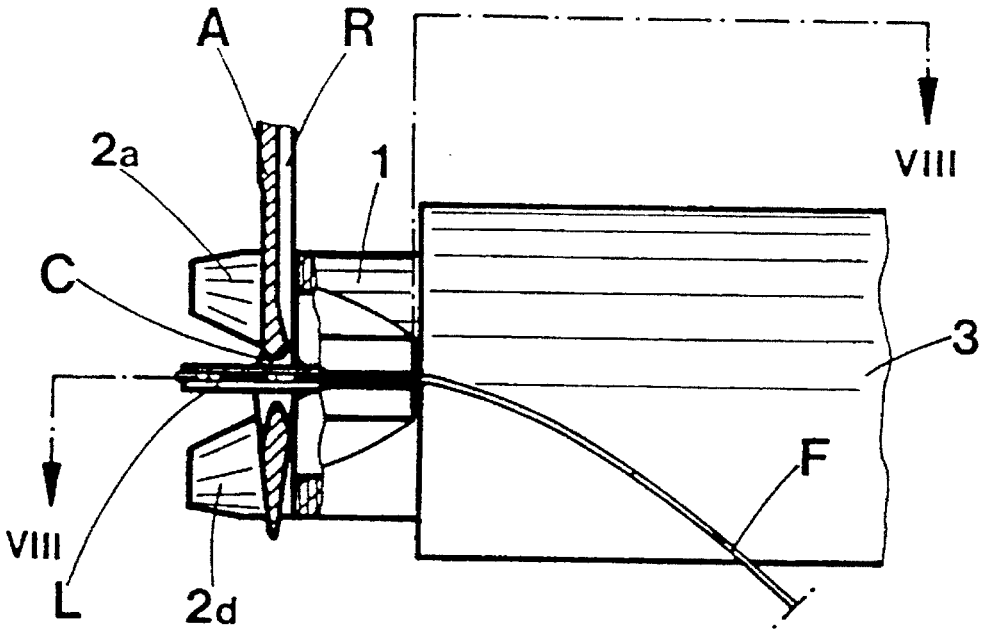
Figure 8:
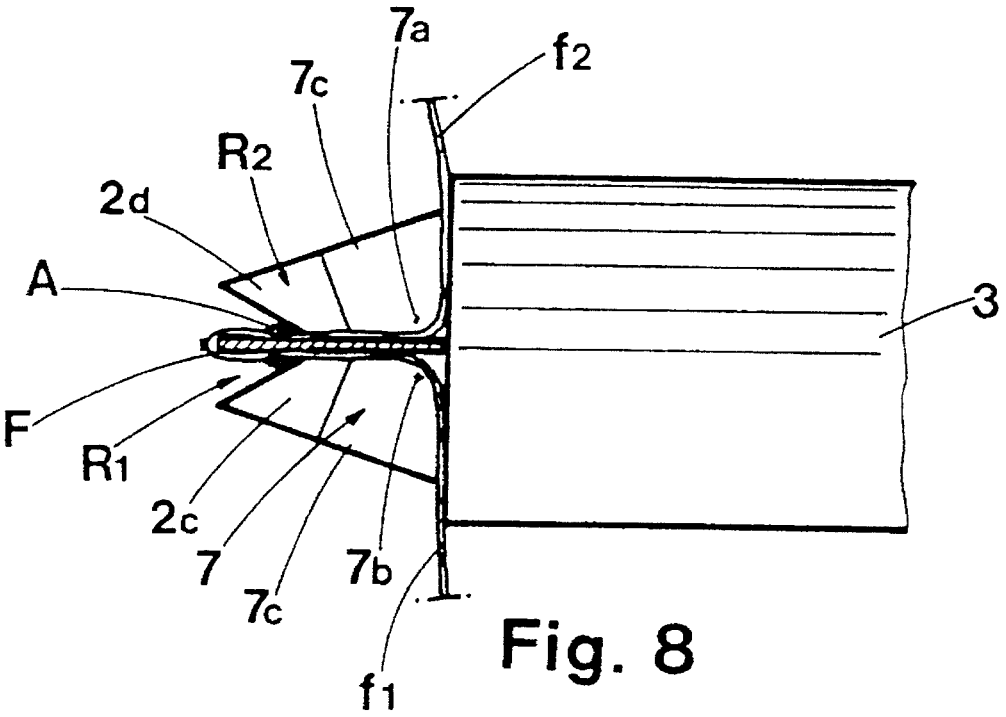

It will be noted that these fingers bound, in pairs, a first groove $R_1$ (FIGS. 1 to 3) of triangular section and a second groove $R_2$, also of triangular section, oriented perpendicularly to the groove $R_1$ (see FIG. 3). In addition, the longitudinal plane of symmetry of the groove $R_1$ coincides with the longitudinal plane of symmetry of the slit 5 of the blade 6, and the longitudinal plane of symmetry of the groove $R_2$ contains a longitudinal symmetric axis of this same slit and blade. Finally, the depth and the opening of the groove $R_1$ are such that a needle A can be easily placed between the respective pairs of fingers 2*a*, 2*b*, and 2*c*, 2*d* bounded by the intersection of the grooves $R_1$ and $R_2$ (FIGS. 1, 7 and 8).

Figure 2:
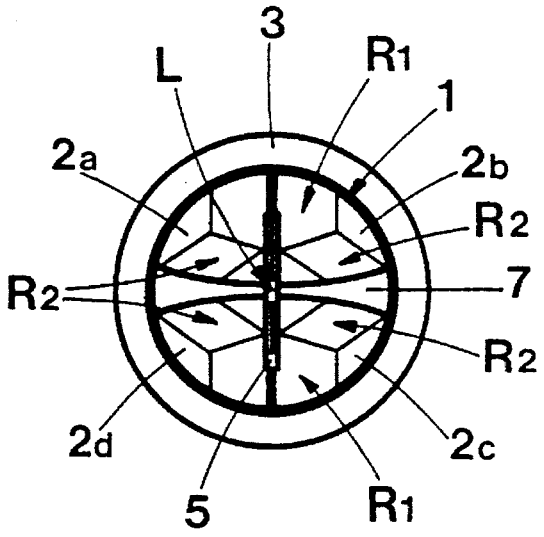
FIG. 2 is a view along line II—II of FIG. 1.

By referring more particularly to FIGS. 2 to 4, it will be noted that the base of the groove $R_2$ communicates with the upper end, in the drawing (FIG. 3), of the slit 5 of the body 1 via a second groove 7 extending to the vicinity of the free end of the lancet L of the blade 6.

This slit 7, oriented perpendicularly to the longitudinal plane of the slit 5, is particularly restricted in its parts 7*a* and 7*b* (FIG. 4) situated near this slit 5, on either side of the latter, and widens gradually moving away from the slit 5 and approaching the lateral surface of the body 1 (lateral openings 7*c*). The minimum width of the slit 7 can be in the order of 1 to 2/10 of a mm, that is to say in the same order of magnitude as the diameter of threads generally used in sewing.

The mode of operation of the described threading device will now be explained.

The thread F to be threaded is first introduced into the groove $R_2$ of the device, either in the space between the pairs of fingers 2a, 2b - 2c, 2d, and this section of thread is led to the base of the slit 7 (FIG. 3), that is to the immediate vicinity of the free end of the lancet L which then occupies its completely retracted position inside the sheath formed by the shells 1*a* and 1*b* and the slit 5 that they bound.

The user takes hold of the device by grabbing the sleeve 3, for example by gripping between the thumb and index finger, and applying it against the part of needle A located above the eye C thereof. As can be seen clearly in FIG. 6, the device is placed against the needle so that the pairs of fingers 2a, 2d - 2b, 2c of the body 1 surround it such that the groove $R_1$ and the eye C occupy a relative position such that their respective planes of symmetry practically coincide.

The user then applies, against the sleeve 3, a force in the direction P (FIG. 6) of sufficient strength to compress the spring 4 so as to bring the free end of the lancet L in contact with the needle A. During this displacement, the lancet L engages, by means of its notch 6*e*, the portion of the thread F located directly in front of the part of the slit 5 of the body 1 opening at the base of the slit 7.

As the thread F is nevertheless pinched by the portions of the walls of the slit bounding the restricted portion 7*a* and 7*b* of the latter, the lancet L cannot entrain, in translation towards the needle A, the whole length of the section of thread F located at the base of the slit 7.

The thread, on the contrary, follows the lancet, (by forming the start of a loop matching the two lateral faces of the lancet, only in the central part of the slit 7, and its segments f1 and f2 slide in this slit, in a direction substantially perpendicular to the axis of the lancet, through the lateral opening 7*c* of the slit 7 of these openings towards the lancet in the vicinity of the opening of the sheath.

Once the lancet L has made contact with the needle A, as shown, the device is displaced in the direction V (FIG. 6), that is to say in the direction of the eye C of the needle A, first over the cylindrical part of the needle, then in the groove R (FIGS. 7 and 10), which every sewing machine needle has, and at the end of this groove, in front of the eye C of the needle, the lancet L then penetrating the eye under the action of the spring, entraining with it the thread F. The groove R thus ensures the guiding of the lancet L toward the eye C.

The user continues to apply pressure on the sleeve 3 initially to bring it into the position visible in FIGS. 7 and 8, in which the sleeve comes into contact with the segments f1 and f2 of the thread F projecting on either side of the base of the slit 7. The angular position of the device is adjusted as necessary relative to the needle A so that the lancet and the groove R of the needle as well as the eye become coplanar.

Figure 9:
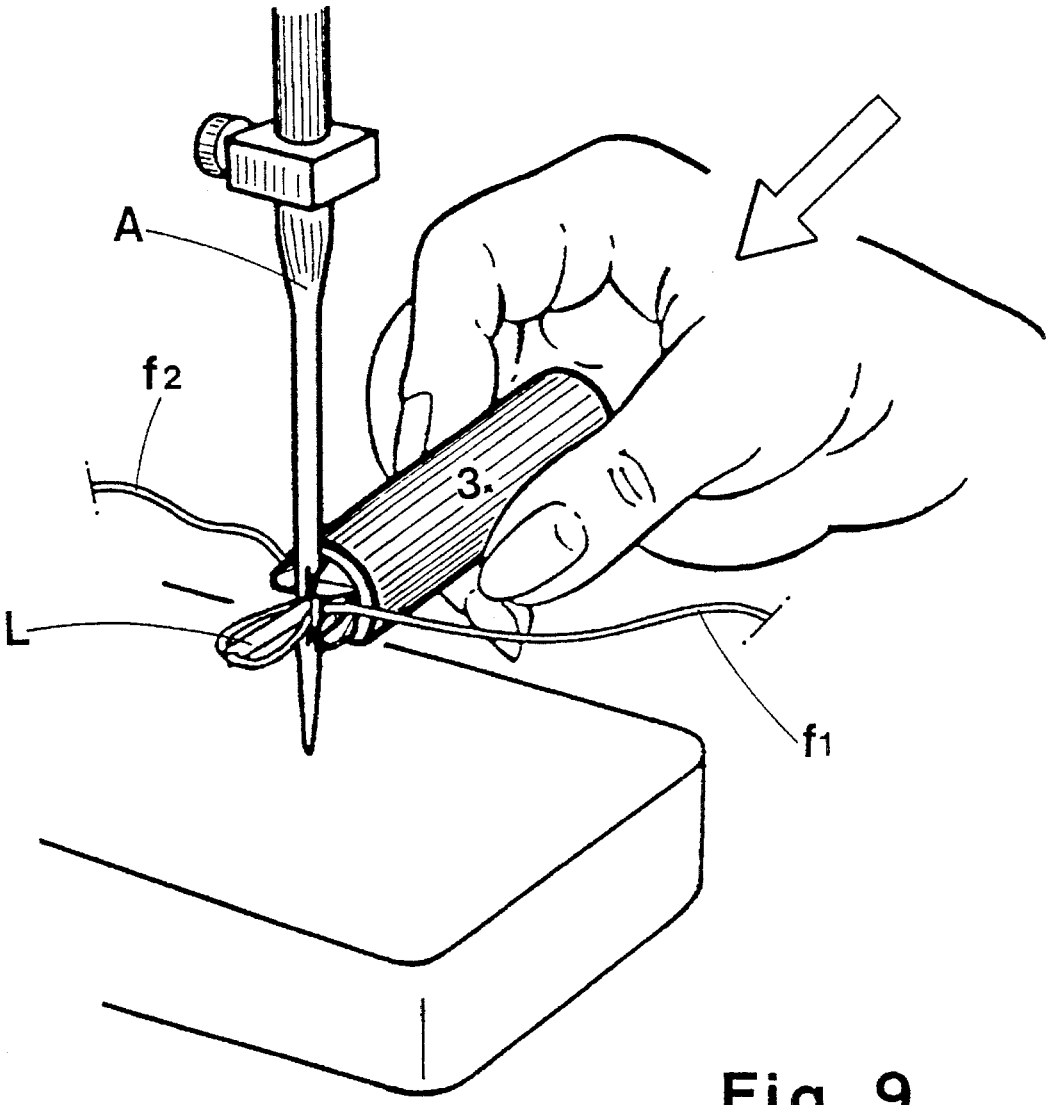

From this moment the sleeve 3 pushes the thread first out of the slit 7 so that it becomes free of the pinching action exerted by the part 7*a* and 7*b* of the latter, then out of the region of the portion of the groove $R_2$ between the slit 7 and the needle A against which the sleeve 3 abuts at the end of its travel (FIGS. 9, 10 and 11), this taking place while the lancet L continues its movement through the eye C of the needle taking with it a greater length of the thread F. Thus, the sleeve 3 constitutes an ejection member for the thread out of the slit 7.

In this regard, it should be noted that due to the tapered shape of the fingers 2*a* to 2*d* of the body 1, the part of the thread F remaining between these fingers becomes, with the displacement of the sleeve 3 in the direction of the needle A, progressively more narrow such that the possible engagement of these fingers on the thread, particularly the friction that they can exert on the thread, in particular on relatively large diameter threads, diminishes gradually as the sleeve 3 approaches the needle. Due to this fact, the freeing of the thread from the possible engagement of the fingers of the body 1 with the thread is greatly facilitated.

As soon as this engagement is sufficiently reduced, the portion of the thread extending through the eye of the needle no longer adheres to the size of the lancet L but begins to form a sort of narrow loop between its part in direct contact with the edge of the notch 6*e* of the lancet and the eye of the needle.

At this point, it should be noted that during their passage through the eye of the needle, the two segments f1 and f2 of the thread F (FIGS. 9 and 10) are slightly wedged between one of the lateral edges of the eye and the lancet L, for one of the segments f1 or f2, and between the other lateral edge of the eye of the needle and this same lancet for the second limb of the thread F.

Due to this fact, the loop of thread formed beyond the eye C of the needle A will remain in place during the withdrawal movement of the lancet L, a movement which commences as soon as the user reduces the amount of pressure exerted on the sleeve 3.

Figure 10:
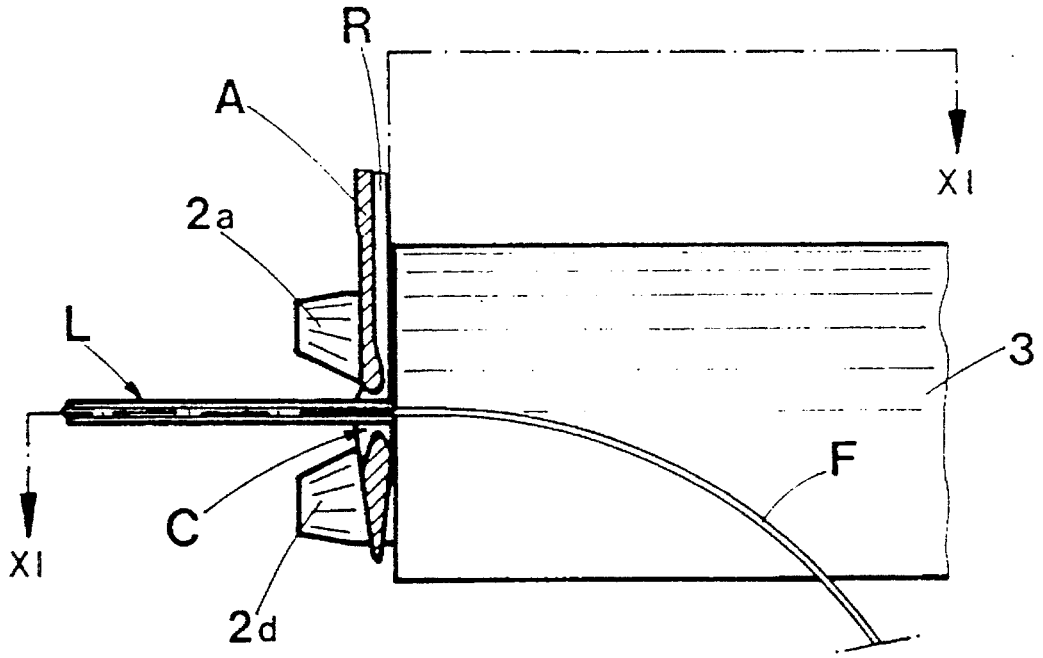
Figure 11:
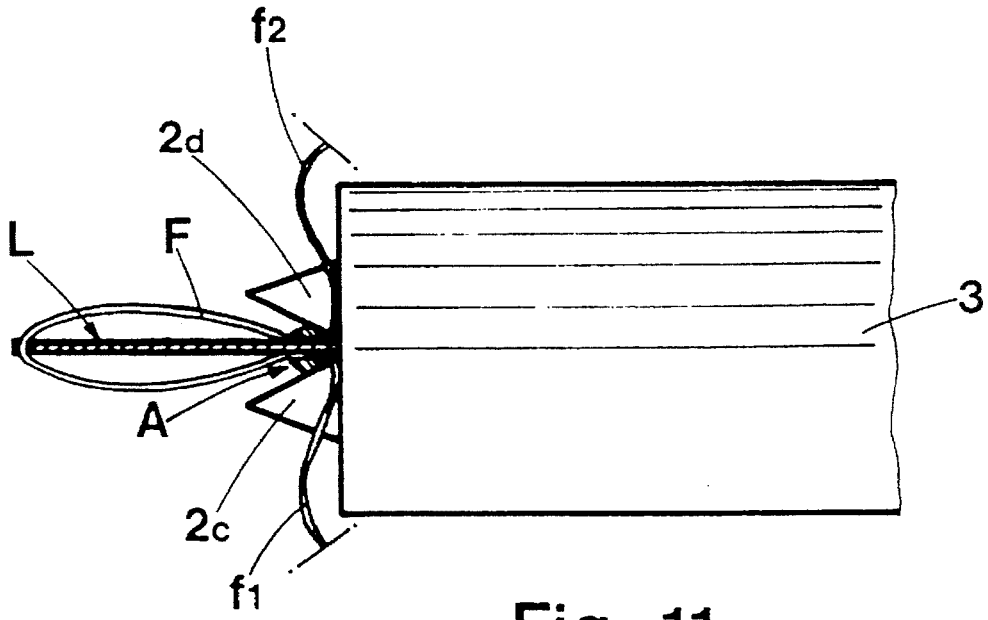
Figure 12:
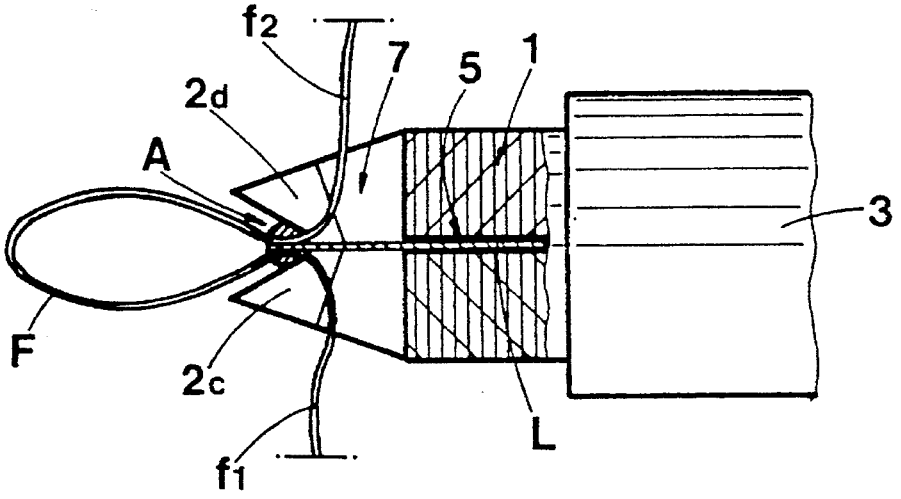

FIG. 12 shows more precisely the shape of the loop of threaded thread immediately before the lancet leaves the eye C of the needle A. The size of this loop is, of course, sufficiently large for a user, even one who is handicapped, to easily grab it with the fingers with a view to feeding through the eye, by pulling on the loop, the segment f1 or f2 of the thread F corresponding to the free end of the thread, thereby completing the threading operation proper. In practice, the size is directly tied to the length of the part of the lancet L capable of passing through the eye of the needle in the position of the components of the device as shown in FIGS. 10 and 11.

Finally, it should be pointed out that in order to facilitate the manipulation of the described device, and more particularly, this correct positioning in contact with the needle to be threaded, the lateral surface of the body 1 of the device is provided with two reference marks 8*a*, 8*b* having a rhombic shape and color contrasting with that of the body. These reference marks are arranged on diametrically opposed parts of the body 1, along the ridges of the junction of the shells 1*a* and 1*b* of the latter and recessed relative to the fingers 2*a* and 2*b*, for the locating device 8*a*, and fingers 2*c* and 2*d* for the locating device 8*b*.

Figure 6:
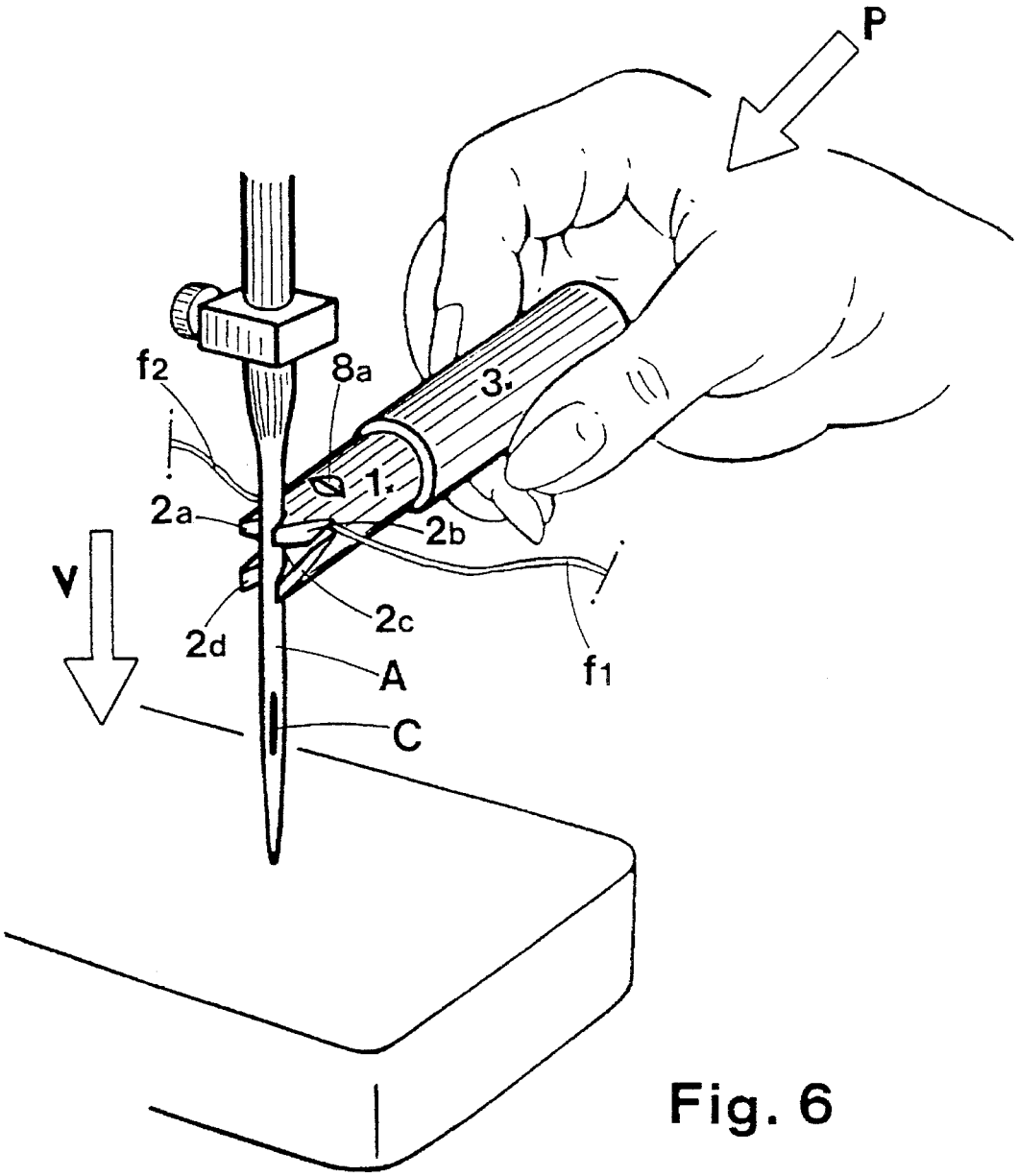
FIGS. 6 to 12 show the method of implementation of the device shown in FIGS. 1 to 5.

Due to these reference marks and as is clearly shown in FIG. 6, in order to operate the threading device described, it is sufficient for the user to present it opposite the needle while one of the reference marks 8*a* and 8*b*, here the mark 8*a*, appears on the upper portion of the body 1 in an imaginary plane passing through the longitudinal axis of the needle.

Nevertheless, even if this operation cannot be realized with the required precision, that is to say even if at the end of the travel of the body 1 in the direction of the needle A, the body is slightly offset relative to the needle, that is in an angular position such as its groove $R_1$ is not strictly opposite the needle but slightly offset relative to the latter, as the body 1 and the sleeve 3 of the device are connected together in a pivoting manner, by engagement of the part 6*c* of the blade 6 in the opening of the flange 3*a* of the sleeve (FIG. 3), the body will tend to orient itself into the correct position as soon as it is brought into contact with the needle by two of its fingers, 2*a* and 2*c*, respectively 2*b* and 2*d*, that is to say the non-adjacent fingers.

In effect, due to their tapered shape and their symmetrical arrangement, these fingers slide on the lateral surface of the needle as soon as they meet the needle and progressively as the device is pushed towards the needle they serve as cams entraining the body 1 in angular movement relative to the sleeve 3 so that the needle is no longer located at the base of the groove $R_1$, between the fingers 2*a* and 2*b*, on the one hand, and 2*c* and 2*d* on the other hand (FIG. 6).

It is convenient at this point to point out that the use of the invention is not limited to the threading of needles fixed at the end of a needle rod of a sewing machine or even embroidering machine.

Such a device can, in effect, be advantageously used to thread needles for manual sewing, particularly needles whose eye is not situated in the vicinity of the tip of the needle, as in the case previously described, but at the opposite end to the tip.

Figure 13:
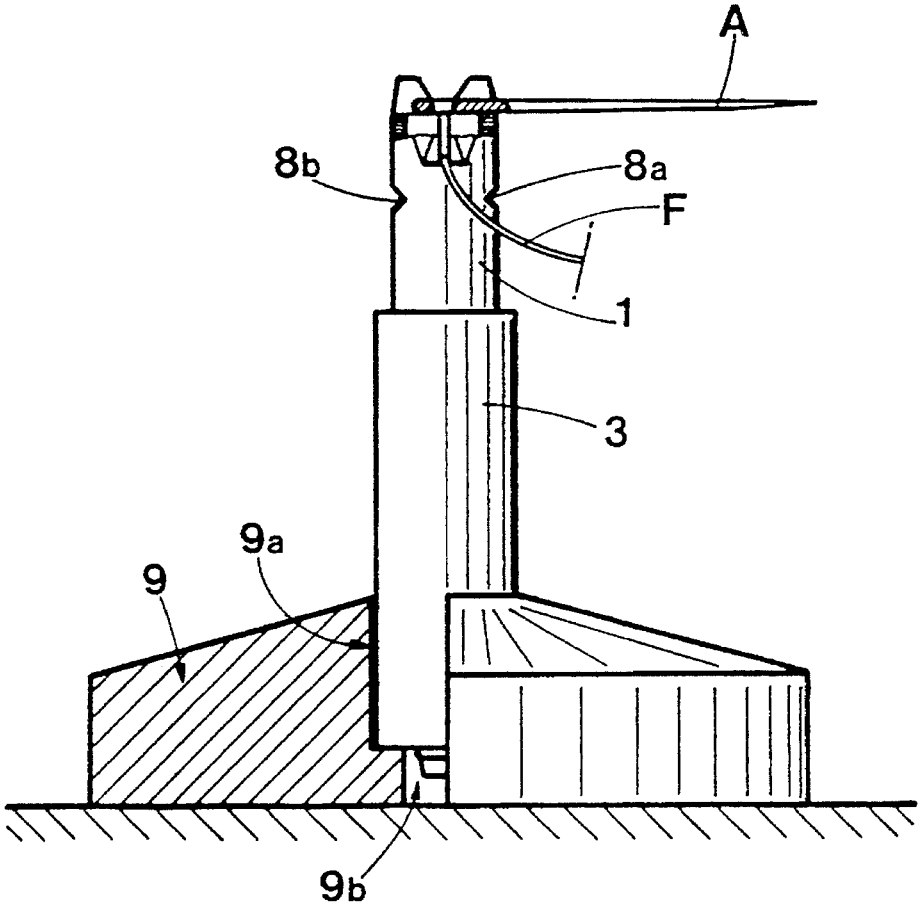
FIG. 13 is an elevational view, in partial section, of the device according to the invention showing its use for the threading of a needle for manual sewing.

It is sufficient, to this end, to provide the device according to the invention with a support permitting the user to place it on a working surface in a favourable position. FIG. 13 shows one possible embodiment of such a support constituted by a base of revolution 9 having at its centre a cylindrical recess 9a in which can be introduced the sleeve 3 of the described threading device and communicating, through its base, with the passage 9*b* in which are located the extremity 6*c* of the blade 6 and the spring clip 60. Furthermore, the diameter of the recess 9*a* can be chosen such that it is lightly greater than the external diameter of the sleeve 3 of the device so as to permit easy separation of the threading device on the base, or positioning of it on the base, in either case by a vertical sliding motion.

In this type of application, the operation of the device is effected by a process kinematically the inverse of that described with reference to FIGS. 7, 8 and 10 to 12. In effect, in this particular case, the thread to be threaded is first introduced into the slit 7 of the body 1 and the needle to be threaded is located between the pairs of fingers 2*a*, 2*b* and 2*c*, 2*d* as illustrated in FIG. 13.

Vertical force is then exerted on the body 1 of the device such that it is withdrawn into the sleeve 3 until the needle A comes into contact with the lancet L following the removal of the latter from its sheath. If necessary, the axial position of the needle is adjusted so that the eye is placed opposite the free end of the lancet L.

The user continues to push the body 1 into the sleeve 3 so that the lancet L and the thread it carries (engaged in the notch 6*d*) penetrates the eye of the needle.

During this operation, the evolution in time of the relative positions of the body 1, the sleeve 3 and the lancet L corresponds exactly to the situation shown in FIGS. 7, 8, 10 and 11 which have been referred to previously.

The user then releases the force exerted on the body 1 so that the latter carries out a rising movement under the action of the spring and the needle A travels along the length of the lancet L causing a loop of thread to appear which progressively becomes larger as the eye of the needle approaches the free end of the lancet L. The user has only to grab this loop with the fingers to complete the threading operation.

I claim:

1. A device for threading a sewing needle, comprising:

a body having an axial passage opening at a first end thereof;

a movable member carrying a blade having a thread gripping member adjacent a tip thereof, said movable member being displaceable in said passage between a first extreme position, in which said blade is withdrawn into the passage, and a second position in which said blade at least partly protrudes from said body;

a pusher member integral with said movable member and slidably mounted on a second end of said body, opposite said first end thereof;

at least one resilient member for biasing said movable member into said first extreme position, said first end of the body having first and second orthogonal front grooves having a profile converging towards said passage, said first groove being coplanar with said axial passage of the body and the distance between said opening and the bottom of said second groove being less than the distance between said passage and the bottom of said first groove; and a narrow slit for receiving a thread therein, connecting the bottom of said second groove and said opening of said axial passage, said slit having transversely converging walls defining a central restricted zone where a pinching action is exerted on said thread for frictionally retaining said thread.

2. A device as claimed in claim 1, wherein said body is cylindrical and said pusher member is a sleeve slidably mounted on said body, said device further comprising:

four tapered fingers projecting from said first end of said body, a first pair of said fingers defining therebetween said first groove, and a second pair of said fingers defining therebetween said second groove and said narrow slit, first and second abutment means for limiting the travel of said sleeve between two axial positions corresponding, for said first abutment means, to said first extreme position of the movable member and, for said second abutment means, to said second extreme position of said movable member, the relative position of said first and second abutment means and of said sleeve being such that when said sleeve engages said first abutment means, said sleeve is withdrawn relative to said narrow slit, and when said sleeve engages said second abutment means, said sleeve surrounds said fingers of the said body at least over a portion thereof, the relative position of said sleeve and said thread gripping member being such that, during displacement of said movable member from its first extreme position to its second extreme position, said gripping member passes a distal portion of said fingers at least when said sleeve begins to recover the pair of the said second pair of said fingers bounding said narrow slit and thus the thread retained between said walls of the slit is progressively pushed out upon displacement of said sleeve toward the second of said extreme positions.

3. A device as claimed in claim 2, further comprising a base with a recess forming a receptacle for said sleeve, the depth of said recess being less than the length of said sleeve.

* * * * *